US012618129B2

(12) United States Patent
Zhao et al.

(10) Patent No.: US 12,618,129 B2
(45) Date of Patent: May 5, 2026

(54) STEEL WITH CONTROLLED YIELD RATIO AND MANUFACTURING METHOD THEREFOR

(71) Applicant: Baoshan Iron & Steel Co., Ltd., Shanghai (CN)

(72) Inventors: Sixin Zhao, Shanghai (CN); Zongze Huang, Shanghai (CN); Jiaqiang Gao, Shanghai (CN); Jun Zhang, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 846 days.

(21) Appl. No.: 17/800,787

(22) PCT Filed: Feb. 7, 2021

(86) PCT No.: PCT/CN2021/075734
§ 371 (c)(1),
(2) Date: Aug. 18, 2022

(87) PCT Pub. No.: WO2021/169779
PCT Pub. Date: Sep. 2, 2021

(65) Prior Publication Data

US 2023/0094959 A1 Mar. 30, 2023

(30) Foreign Application Priority Data

Feb. 28, 2020 (CN) ..... 202010130904.1

(51) Int. Cl.
*C22C 38/58* (2006.01)
*C21D 1/25* (2006.01)
(Continued)

(52) U.S. Cl.
CPC ..... *C22C 38/58* (2013.01); *C21D 1/25* (2013.01); *C21D 1/58* (2013.01); *C21D 1/60* (2013.01);
(Continued)

(58) Field of Classification Search
CPC ..... C22C 38/58; C22C 38/001; C22C 38/002; C22C 38/02; C22C 38/04; C22C 38/06;
(Continued)

(56) References Cited

U.S. PATENT DOCUMENTS 8,357,252 B2 1/2013 Nagao et al.
10,266,911 B2 4/2019 Hayashi et al.
(Continued)

FOREIGN PATENT DOCUMENTS

CN 102747303 A 10/2012
CN 106136737 A 1/2019
(Continued)

OTHER PUBLICATIONS

International Searching Authority—International Search Report, pertaining to International Application No. PCT/CN2021/075734, dated Apr. 27, 2021, together with the Written Opinion of the International Searching Authority, 12 pages.
(Continued)

*Primary Examiner* — Danielle M. Carda
(74) *Attorney, Agent, or Firm* — Barclay Damon LLP

(57) ABSTRACT

Disclosed are a steel with controlled steel ratio and a manufacturing method therefor. The steel comprises the following components in percentage by mass: C: 0.245-0.365%, Si: 0.10-0.80%, Mn: 0.20-2.00%, P: ≤0.015%, S: ≤0.003%, Cr: 0.20-2.50%, Mo: 0.10-0.90%, Nb: 0-0.08%, Ni: 2.30-4.20%, Cu: 0-0.30%, V: 0.01-0.13%, B: 0-0.0020%, Al: 0.01-0.06%, Ti: 0-0.05%, Ca: ≤0.004%, H: ≤0.0002%, N: ≤0.013%, O: ≤0.0020%, and the balance of Fe
(Continued)

and inevitable impurities, wherein the components satisfy (8.57*C+1.12*Ni)≥4.8% and 1.2%≤(1.08*Mn+2.13*Cr)≤5.6%. The steel has excellent low-temperature impact toughness and aging impact toughness at −20° C. and −40° C., a rationally controlled yield ratio, and ultra-high strength, ultra-high toughness, and ultra-high plasticity, which can be used in applications such as offshore platform mooring chains, mechanical structures, and automobiles that require high strength and toughness of the steel.

8 Claims, 1 Drawing Sheet

(51) Int. Cl.

| | |
|---|---|
| ***C21D 1/58*** | (2006.01) |
| ***C21D 1/60*** | (2006.01) |
| ***C21D 9/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |

(52) U.S. Cl.
CPC ..... *C21D 9/0081* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C21D 2211/002* (2013.01); *C21D 2211/008* (2013.01)

(58) Field of Classification Search
CPC ..... C22C 38/42; C22C 38/44; C22C 38/46; C22C 38/48; C22C 38/50; C22C 38/54; C21D 1/25; C21D 1/58; C21D 1/60; C21D 9/0081; C21D 2211/002; C21D 2211/008; C21D 1/18; C21D 7/13; C21D 6/004; C21D 6/005; C21D 8/0205; C21D 8/0226; C21D 8/0247; C21D 8/065; C21D 9/46; C21D 9/525; C21D 1/63; C21D 8/02
USPC ..... 148/548
See application file for complete search history.

(56) References Cited

U.S. PATENT DOCUMENTS

| | | | |
|---|---|---|---|
| 2015/0354040 | A1 | 12/2015 | Zhao et al. |
| 2018/0044754 | A1 | 2/2018 | Azuma et al. |

FOREIGN PATENT DOCUMENTS

| | | | | | |
|---|---|---|---|---|---|
| CN | 109136737 | A | * | 1/2019 | ..... C22C 38/06 |
| CN | 110144516 | A | | 8/2019 | |
| JP | S5565323 | A | | 5/1980 | |
| JP | S58171558 | A | | 10/1983 | |
| JP | H03229826 | A | | 10/1991 | |
| JP | H03232946 | A | | 10/1991 | |
| JP | 2005264275 | A | | 9/2005 | |
| RU | 2442839 | C2 | | 2/2012 | |
| RU | 2605034 | C1 | | 12/2016 | |
| RU | 2659549 | C2 | | 7/2018 | |
| RU | 2683397 | C1 | | 3/2019 | |
| SU | 602595 | A1 | | 4/1978 | |

OTHER PUBLICATIONS

The State Intellectual Property Office of People's Republic of China—First Office Action pertaining to Application No. 202010130904.1, together with it's English translation, 12 pages (no date).
Examination Report No. 1 in Australian Application No. 2021226961 dated Jul. 4, 2023, 2 pages.
Extended European Search Report in EP Application No. 21761014.6 dated May 23, 2024, 12 pages.
Notification for Reasons of Refusal in Japanese Application No. 2022551534 dated Sep. 12, 2023 [with English translation], 9 pages.
Grounds for Rejection in Korean Application No. 10-2022-7028605 dated May 21, 2024 [with English translation], 16 pages.
Official Action and Search Report in Russian Application No. 2022122889 dated Feb. 6, 2023 [with English translation of Action], 13 pages.

* cited by examiner

STEEL WITH CONTROLLED YIELD RATIO AND MANUFACTURING METHOD THEREFOR

CROSS-REFERENCE TO RELATED APPLICATIONS

This application is a U.S. national phase entry under 35 USC § 371 of Patent Cooperation Treaty Application No. PCT/CN202 1/075734 filed Feb. 7, 2021, which in turn claims priority from Chinese Patent Application 202010130904.1 filed Feb. 28, 2020. Each of the above described applications is hereby incorporated herein by reference in their entireties.

TECHNICAL FIELD

The present invention relates to a steel having high strength and toughness, in particular to a steel with controlled yield ratio having excellent low-temperature impact toughness and a manufacturing method therefor.

BACKGROUND

Steel having high strength and toughness, such as steel rods and plates having ultra-high strength and toughness, are applied in the fields of offshore platforms, huge mechanical structures, and high-strength sheets for automobiles. The strength grades of round steels for offshore platform mooring chains include a tensile strength 690 MPa grade R3, a tensile strength 770 MPa grade R3S, a tensile strength 860 MPa grade R4, a tensile strength 960 MPa grade R4S, a tensile strength 1,000 MPa grade R5, and a tensile strength 1,100 MPa grade R6. In the ship rules published by the DNV Classification Society in July 2018, R6 has been incorporated in the new ship rules. while technical indexes of R6 are stipulated in the factory certification outline, Approval of manufacturers DNVGL-CP-0237 Offshore mooring chain and accessories (Edition July 2018) and the chain link standard DNVGL-OS-E302 Offshore mooring chain (Edition July 2018), and the main technical indexes of R6 include a low temperature impact energy at −20° C. of 60J or more, a tensile strength of 1,100 MPa or more, a yield strength of 900 MPa or more, an elongation rate of 12% or more, an area reduction of 50% or more, an aging impact energy at −20° C. (holding at a temperature of 100° C. for 1 h after 5% strain) of 60J or more, a yield ratio of 0.85-0.95, etc. The mooring chain is used for fixing the offshore platform and has demands for ultra-high strength, high toughness, high corrosion resistance, and the like. In consideration of cases that the offshore platform needs to be constructed in sea areas at various latitudes and the cold climate in high-latitude sea area, the impact performance at an environment temperature of −40° C. needs to be considered simultaneously. If the yield ratio of the mooring chain is too high, easy fracture after deformation may occur, which is harmful to the safety of the offshore platform. The offshore platform mooring chain needs ultra-high strength, high toughness and high plasticity at the same time, and thus, the steel needs to have ultra-high strength, toughness and plasticity. The offshore platform mooring chain may deform during service and needs to have good low-temperature impact toughness if deformation occurs. Therefore, the aging impact energy is an important technical index for the offshore platform mooring chain.

Many studies have been conducted on steel having ultra-high strength, toughness and plasticity all over the world.

The steel having ultra-high strength and toughness usually adopts a microstructure of bainite, bainite+martensite, or martensite. The bainite or martensite structure contains supersaturated carbon atoms, which may change the lattice constant, inhibit the dislocation motion, and improve the tensile strength. A refined structure ensures that the steel can absorb more energy under stress so as to achieve higher tensile strength and impact toughness.

Chinese patent CN102747303A discloses "a high strength steel plate with a yield strength of 1,100 MPa-grade and a manufacturing method thereof". The high strength steel plate is a steel plate having ultra-high strength and toughness with a yield strength of 1,100 MPa and low temperature impact energy (−40° C.), and comprises the following components in percentage by mass: C: 0.15-0.25%, Si: 0.10-0.50%, Mn: 0.60-1.20%, P: ≤0.013%, S: ≤0.003%, Cr: 0.20-0.55%, Mo: 0.20-0.70%, Ni: 0.60-2.00%, Nb: 0-0.07%, V: 0-0.07%, B: 0.0006-0.0025%, Al: 0.01-0.08%, Ti: 0.003-0.06%, H: ≤0.00018%, N: ≤0.0040%, 0: ≤0.0030%, and the balance of Fe and inevitable impurities, wherein the carbon equivalent satisfies CEQ≤0.60%. The steel has a yield strength of 1,100 MPa or more, a tensile strength of 1,250 MPa or more, and a Charpy impact energy Akv (−40° C.) of 50J or more. The steel plate disclosed by the patent has ultra-high strength, but the impact performance at −40° C. cannot reach 70J stably, and has low elongation rate, while the aging impact performance and the yield ratio are not stipulated, either.

Chinese patent CN103898406A discloses "a steel plate with a yield strength of 890 Mpa-grade and low welding crack sensitivity and a manufacturing method thereof", which adopts heat-control mechanical rolling and cooling technology to obtain a steel having high strength toughness with a matrix structure of ultrafine bainite lath. The steel plate comprises the following components in percentage by weight: C: 0.06-0.13%, Si: 0.05-0.70%, Mn: 1.2-2.3%, Mo: 0-0.25%, Nb: 0.03-0.11%, Ti: 0.002-0.050%, Al: 0.02-0.15%, and B: 0-0.0020%, wherein the components satisfy 2Si+3Mn+4Mo≤8.5, and the balance of Fe and inevitable impurities. The steel plate has a yield strength of greater than 800 MPa, a tensile strength of greater than 900 MPa, and a Charpy impact energy Akv (−20° C.) of 150J or more. However, in the embodiments of the patent, the area reduction is not stipulated, while the yield ratio, the low-temperature impact energy at −40° C. and the aging impact energy are not defined, either.

Chinese patent CN107794452A discloses "a strip continuously casted steel for automobile having ultra-high strength plasticity product and continuous-yielding and a manufacturing method thereof", comprising the following components in percentage by weight: C: 0.05-0.18%, Si: 0.1-2.0%, Mn: 3.5-7%, Al: 0.01-2%, P: ≤0.02% and greater than 0, and the balance of Fe and other inevitable impurities with a microstructure of ferrite+austenite+martensite. The patent adopts a three-phase composite technology having a soft phase such as ferrite and hard phases such as martensite and austenite to produce a steel with a yield strength of 650 MPa or more, a tensile strength of 980 MPa, an elongation rate of ≥20%, and a strength plasticity product of ≥20 GPa*%. This type of steel can be applied to an automobile exterior plate. However, the product disclosed by the patent has no provisions on the yield ratio, the impact energy, and the aging impact, i.e., cannot satisfy high strength, plasticity and toughness at the same time.

The Chinese patent CN103667953A discloses "an offshore mooring chain steel having low environmental crack sensitivity, ultra-high strength and toughness and a manufacturing method thereof". The steel comprises: C: 0.12-0.24%, Mn: 0.10-0.55%, Si: 0.15-0.35%, Cr: 0.60-3.50%, Mo: 0.35-0.75%, N: ≤0.006%, Ni: 0.40-4.50%, Cu: ≤0.50%, S: ≤0.005%, P: 0.005-0.025%, O: ≤0.0015%, and H: ≤0.00015%. The mooring chain steel having high strength and toughness is produced by adopting the components above and a secondary quenching process, and has a tensile strength of 1,110 MPa or more, a yield ratio of 0.88-0.92, an elongation rate of 12% or more, an area reduction of 50% or more, and an impact energy ($A_{kv}$) at −20° C. of 50J or more. According to the patent, the elongation rate of the mooring chain is 15.5%, 13.5%, 13.5%, and 15.0%, respectively, and the low-temperature impact energy $A_{kv}$ at −20° C. is 67J, 63J, 57J, and 62J, respectively. The low-temperature impact energy of the product disclosed by the patent cannot stably satisfy the demands of the DNV Classification Society with respect to the Charpy impact energy of 60J or more. After 5% strain, the steel is aged, which increases the dislocation density in the steel and resulting in aggregation of the interstitial atoms towards the dislocations, and thus, the aging impact energy is lower than the conventional impact energy. According to the data of the patent, the value of the aging impact energy $A_{kv}$ at −20° C. cannot meet the demand of 60J, either.

It can be seen from the analysis of the prior arts above that none of them can meet the demands for high strength, toughness, and plasticity, specified yield ratio, and high aging impact energy.

SUMMARY OF THE INVENTION

The present invention aims to provide a steel with controlled yield ratio having excellent low-temperature impact toughness and a manufacturing method therefor. The steel has an excellent low-temperature impact toughness and aging impact toughness at −20° C. and −40° C., a rationally controlled yield ratio, and ultra-high strength, ultra-high toughness, and ultra-high plasticity. The steel can be used in applications such as offshore platform mooring chains, mechanical structures, and automobiles that require high strength and toughness of the steel.

In order to achieve the aim above, the technical solutions of the present invention are as follows:

A steel with controlled yield ratio having excellent low-temperature impact toughness, comprising the following components in percentage by mass: C: 0.245-0.365%, Si: 0.10-0.80%, Mn: 0.20-2.00%, P: ≤0.015%, S: ≤0.003%, Cr: 0.20-2.50%, Mo: 0.10-0.90%, Nb: 0-0.08%, Ni: 2.30-4.20%, Cu: 0-0.30%, V: 0.01-0.13%, B: 0-0.0020%, Al: 0.01-0.06%, Ti: 0-0.05%, Ca: ≤0.004%, H: ≤0.0002%, N: ≤0.013%, O: ≤0.0020%, and the balance of Fe and inevitable impurities, wherein the components satisfy (8.57*C+1.12*Ni)≥4.8% and 1.2%≤(1.08*Mn+2.13*Cr)≤5.6%; and the steel with controlled yield ratio has a yield ratio of 0.85-0.95, a tensile strength of 1,100 MPa or more, and a yield strength of 900 MPa or more.

The microstructure of the steel with controlled yield ratio provided by the present invention is tempered martensite+tempered bainite.

The steel with controlled yield ratio provided by the present invention has a Charpy impact energy $A_{kv}$ at −20° C. of 90J or more, a Charpy impact energy $A_{kv}$ at −40° C. of 70J or more, a Charpy impact energy $A_{kv}$ at −20° C. of 80J or more after holding at a temperature of 100° C. for 1 h after 5% strain, a Charpy impact energy $A_{kv}$ at −40° C. of 60J or more after holding at a temperature of 100° C. for 1 h after 5% strain, a yield ratio of 0.85-0.95, a tensile strength of 1,100 MPa or more, a yield strength of 900 MPa or more, an elongation rate of 15% or more, an area reduction of 50% or more, a strength toughness product (Tensile Strength*Charpy Impact Energy $A_{kv}$ at −20° C.) of 115 GPa*J or more, and a strength plasticity product (Tensile Strength*Elongation Rate) of 16 GPa*% or more. The steel with controlled yield ratio can be used for manufacturing high-performance offshore platform mooring chain, structural member having ultra-high strength and toughness, and the like.

The design concepts of the component of the steel with controlled yield ratio provided by the present invention are as follows:

C: carbon element is solid-dissolved in the octahedron of the austenite face-centered cubic lattice at a temperature above the austenitizing temperature. In the cooling process, if the cooling rate is relatively low, diffusive phase transformation controlled by diffusion of carbon atoms may occur. With the increase of the cooling rate, supersaturation of carbon in ferrite would gradually increase. When the cooling rate exceeds the critical cooling rate of martensite phase transformation, a martensite structure may be formed. According to the present invention, influence of the carbon atoms on the diffusive phase transformation is sufficiently utilized to form a martensite and bainite structure containing certain amount of supersaturated carbon, thereby controlling the yield ratio of the composite phase structure of martensite and bainite, and meanwhile, providing a relatively high strength to the steel. Therefore, in the present invention, the C content is controlled to be 0.245-0.365%.

Si: Si is solid-dissolved in steel and plays the role of solid solution strengthening. As the solubility of Si in cementite is very low, a carbide-free bainite structure will be formed under a relatively high Si content, however, it would reduce the impact toughness and plasticity. In comprehensive consideration of the influence of Si on the solid solution strengthening effect and the brittleness in the present invention, the Si content is controlled to be 0.10-0.80%.

Mn: Mn in steel usually exists in a solid solution form. When the steel is subjected to an external force, Mn atoms solid-dissolved in the steel will inhibit the dislocation motion and improve the strength of the steel. However, the excessively high content of the Mn element will aggravate the segregation in the steel, resulting in unevenness of the structure and unevenness of performance. Therefore, in the present invention, 0.20-2.00% of Mn is incorporated.

P: P element may segregate at dislocations and grain boundaries in steel, reducing the binding energy of the grain boundaries. When being subjected to low-temperature impact, steel with high P content is liable to fracture due to the decrease of the binding energy of the grain boundaries. By controlling of the P content in ultra-high strength steel, it is beneficial for improving low-temperature impact toughness of the steel. In the present invention, the P content is limited not to exceed 0.015% so as to ensure low-temperature impact toughness.

S: S in steel may form relatively large MnS inclusions with Mn, reducing the low-temperature impact toughness of the steel. Meanwhile, the MnS inclusions may improve the cutting performance of the steel. A certain content of S can be added in free-cutting steel so as to reduce the damage frequency of the tool in the machining process of the steel. As the type of steel provided by the present invention requires good low-temperature impact toughness, and thus, in the present invention, the S content does not exceed 0.003%.

Cr: Cr atoms solid-dissolved in steel can inhibit diffusive phase transformation and improve hardenability of the steel, so that the steel forms a high-hardness structure. In the tempering process after quenching, Cr can form carbides with C so that the dispersed carbides are beneficial for improving the strength of the steel. The excessively high content of Cr element may form coarse carbides, which will affect the low-temperature impact performance. Therefore, in the present invention, 0.20-2.50% of Cr is incorporated so as to ensure the strength and the low-temperature impact performance of the steel.

Mo: The addition of alloying element Mo in steel can effectively inhibit diffusive phase transformation and promote the formation of bainite and martensite. In the tempering process, Mo may form carbides with C. The fine carbides can reduce the degree of dislocation annihilation in the tempering process, improve the strength of the steel, and ensure the low-temperature impact toughness after tempering. Excessively high Mo content may form larger carbides and reduce impact energy. In the present invention, 0.10-0.90% of Mo is incorporated so as to obtain corresponding good strength and toughness.

Nb: Nb can increase the recrystallization temperature of steel, and Nb in the tempering process may form finely dispersed NbC and NbN so as to improve the strength of the steel. If the Nb content is excessively high, the size of carbonitrides of Nb will be relatively large, which will deteriorate the impact energy of the steel. Nb, V, and Ti may form carbonitride complexes with C and N, resulting in decrease of the strength of the steel. In the present invention, 0-0.08% of Nb is incorporated so as to ensure the mechanical performance of the steel.

Ni: addition of a certain amount of Ni in steel can reduce the stacking fault energy of the BCC phase in the body-centered cubic lattice such as tempered bainite and tempered martensite in the steel. The steel containing Ni can deform under impact load to absorb more energy, which improves the impact energy of the steel. At the same time, Ni is an austenite stabilizing element. However, relatively high Ni content may facilitate increase of the stability of austenite so that the final structure may contain excessive austenite, which would reduce the strength of the steel. Therefore, in the present invention, 2.30-4.20% of Ni is added so as to ensure the low-temperature impact toughness and strength of the steel.

Cu: The addition of Cu element in steel will result in precipitation of E-Cu in the tempering process, which can improve the strength of the steel. However, as the melting point of the Cu element is low, an excessive amount of Cu may cause aggregation of Cu at the grain boundaries during the heating process of the steel billet, thereby reducing the toughness. Therefore, in the present invention, the Cu content cannot exceed 0.30%.

V: The addition of a certain amount of V in steel will result in formation and precipitation of carbonitrides of V in the tempering process, which can improve the strength of the steel. Nb, V, and Ti are all carbonitride forming elements, and a relatively high V content may cause precipitation of coarse VC, which reduces the impact performance. Therefore, in the present invention, in combination with the other alloying elements, 0.01-0.13% of V is incorporated so as to ensure the mechanical performance of the steel.

B: B has a small atomic radius which exists in the form of interstitial atoms and aggregates at the grain boundaries of steel so as to inhibit the nucleation of diffusive phase transformation, so that the steel can form a low-temperature phase transformation structure such as bainite or martensite. If the steel contains Mn, Cr, Mo and other alloying elements, due to the effect of dissipating free energy on the diffusion phase transformation interface, the diffusive phase transformation can also be inhibited. If the B content is excessively high, the large amount of B aggregated at the grain boundaries may reduce the binding energy of the grain boundaries and cause decrease of the impact performance. Therefore, in the present invention, the amount of B incorporated is 0-0.0020%.

Al: Al is incorporated into steel as a deoxidizing element, and meanwhile, Al can refine the grains. If the Al content is excessively high, relatively large alumina inclusions may be formed, which will affect the impact toughness and the fatigue life of the steel. Therefore, in the present invention, 0.01-0.06% of Al is incorporated so as to improve the toughness of the steel.

Ti: Ti in steel may form TiN at high temperature to refine the grains of austenite. If the Ti content is excessively high, coarse square TiN may be formed, resulting in local stress concentration and decrease of the impact toughness and the fatigue life. Ti may also form TiC with C in the steel during the tempering process so as to improve the strength. In comprehensive consideration of the effects of Ti in refining the grains, improving the strength, and deteriorating the toughness, in the present invention, the Ti content is controlled to be 0-0.05%.

Ca: Ca in steel can spheroidize the sulfide so as to avoid influence of the sulfide on impact toughness, but if the Ca content is excessively high, inclusions may be formed and the impact toughness and fatigue performance are deteriorated. Therefore, the Ca content is controlled to be 0.004% or below.

H: H in steel can be segregated at dislocations, sub-grain boundaries, and grain boundaries to form hydrogen molecules under the action of edge dislocation hydrostatic stress field. An ultra-high strength steel with a tensile strength over 900 MPa has high dislocation density, and hydrogen is liable to aggregate at the dislocations, resulting in hydrogen-induced cracking or delayed cracking during service of the steel. Control of the hydrogen content is a key factor for ensuring the safe application of the ultra-high strength steel. Therefore, in the present invention, the H content is controlled not to exceed 0.0002%.

N and O: N in steel may form MN and TiN with Al and Ti to refine austenite grains. However, when the N content is excessively high, N will aggregate at dislocations, which deteriorates the impact performance. Therefore, the N content should be controlled not to exceed 0.013%. Oxygen in steel may form oxides with Al and Ti which deteriorate the impact performance. Therefore, the O content should not exceed 0.0020%.

Particularly, in the present invention, $8.57*C+1.12*Ni \geq 4.8\%$ is satisfied by controlling the content of C and Ni. The content of solid-dissolved carbon in bainite and the ratio of martensite are controlled by controlling the content of the C element, and the impact toughness of the steel is controlled by the Ni element so as to achieve ultra-high strength and good low-temperature impact toughness. By controlling the content of P, S and H, the segregation of P and H at the grain boundaries and the decrease of the impact energy is avoided. By controlling the content of Nb, V, Ti and other alloying elements, dispersed fine carbonitride precipitates are formed, and in the tempering process, on the one hand, a uniform microstructure will be formed, and on the other hand, the decrease of the strength due to tempering can be avoided. By controlling the content of Mn, Cr, Mo and other elements, the solid solution strengthening effect of Mn is sufficiently utilized so as to inhibit the diffusive phase transformation, forming a refined bainite and martensite structure. In the present invention, 1.2%≤1.08*Mn+2.13*Cr≤5.6% is required, so as to optimize the influence of the ratios of the Mn and Cr elements on hardenability, i.e., avoid the case that cannot obtain the ultra-high strength structure due to poor hardenability caused by extremely low content of Mn and Cr elements, and meanwhile, avoid the formation of too much high-hardness martensite structure due to high hardenability caused by the excessive content of the Mn and Cr elements that reduces the impact energy and the elongation rate. By utilizing the Cr and Mo elements, the hardenability of the steel is improved, and the fine carbide precipitates are formed in the tempering process so as to improve the impact toughness of the steel.

The manufacturing method of the steel with controlled yield ratio having excellent low-temperature impact toughness according to the present invention comprises the following steps:

S1: smelting and casting, wherein the smelting and casting are carried out according to the components in any one of claims 1-3 to form a casting billet;

S2: heating, wherein the casting billet is heated at a heating temperature of 1,010-1,280° C.;

S3: rolling or forging, wherein a final rolling temperature is 720° C. or more or a final forging temperature is 720° C. or more; and performing air cooling, water cooling or retarded cooling after the rolling;

S4: quenching heat treatment, wherein the quenching is performed at a quenching temperature of 830-1,060° C. using water quenching or oil quenching, and a ratio of the quenching time to the thickness or diameter of the steel is 0.25 min/mm or more; and S5: tempering heat treatment, wherein a tempering temperature is 490-660° C., a ratio of the tempering time to the thickness or diameter of the steel is 0.25 min/mm or more, and performing air cooling, retarded cooling or water cooling after the tempering.

According to the present invention, the casting billet is heated and austenitized at a temperature of 1,010-1,280° C.; phenomena such as carbonitride dissolution, austenite grain growth, and the like takes place in the billet in the heating process; part of or all of the carbides of Cr, Mo, Nb, V, and Ti incorporated in the steel are dissolved in the austenite, and the undissolved carbonitrides may pin at the grain boundaries of the austenite and inhibit the growth of the austenite grains. The solid-dissolved alloying elements such as Cr, Mo, and the like in the steel can inhibit the diffusive phase transformation in the cooling process, forming intermediate and low temperature transformation structures such as bainite, martensite, and the like, which can improve the strength of the steel.

According to the present invention, the steel is rolled and forged at a temperature of 720° C. or above. The dynamic recrystallization, static recrystallization, dynamic recovery, static recovery, and the like that occur in the steel facilitate the formation of the refined austenite grains, and retain certain numbers of dislocations and sub-grain boundaries in the austenite grains. In the cooling process, a refined bainite and martensite matrix structure is formed, as well as the carbonitrides.

After being rolled or forged, the steel according to the present invention is heated to 830-1,060° C. and hold. Then the steel is quenched. In the quenching heat treatment process, the carbonitrides of Nb, V, and Ti dissolve partially, while carbides of Cr and Mo also partially dissolve at the same time along with the nitrides of Al, then undissolved carbonitrides and carbides pin the austenite grain boundaries so as to suppress the growth of the austenite grains. In the quenching process after cooling, due to the relatively high cooling rate, a finer bainite and martensite structure is formed. Such structure has ultra-high strength and good toughness.

The steel according to the present invention is then subjected to tempering heat treatment at a temperature of 490-660° C., and in the tempering process, annihilation of unlike dislocations and precipitation of the carbonitrides will occur. Dislocation annihilation results in decrease of the internal stress and the strength of the steel, and meanwhile, decrease of the number of microdefects such as dislocations, sub-grain boundaries, and the like in the crystals can improve the impact toughness of the steel. Precipitation of the fine carbonitrides is beneficial for improving the strength and the impact toughness. High-temperature tempering is beneficial for improving the homogeneity of the steel. When the steel is subjected to plastic deformation, excellent homogeneity can improve the elongation rate. In combination with the component system design of the present invention, with the temperature range of the tempering heat treatment, steel with ultra-high strength, toughness and plasticity, and good aging impact performance can be formed.

The steel with controlled yield ratio having excellent low-temperature impact toughness produced according to the components and the process disclosed in the present invention can be used in applications such as offshore platform mooring chains, automobiles, mechanical structures, and the like that require rods having high strength and toughness.

The present invention has the advantageous effects as follows:

In terms of chemical composition, the present invention adopts optimized C and Ni content design, and combines with Cr, Mo, and micro-alloying elements such as Nb, V, Ti, and the like, so as to form a refined intermediate and low temperature transformation structure by the alloying elements that provide the improved hardenability, along with a proper amount of Ni to reduce the stacking fault energy of ferrite and improve the toughness. Further, refined tempered bainite and tempered martensite is formed by the quenching and tempering process, which can provide excellent structure homogeneity, strength and plasticity. In the tempering process, the fine dispersed carbonitrides are formed, so as to improve the strength of the steel and ensure the toughness.

The type of the steel provided by the present invention can achieve corresponding high strength toughness and high strength plasticity by primary quenching process only, which omits quenching steps comparing to secondary quenching process thereby reducing the cost for production and carbon emission. Therefore, the steel is also an environmental-friendly steel.

The steel according to the present invention has reasonable component and process design and wide process window, which is suitable for implementing mass commercialized production for rods or plates.

DETAILED DESCRIPTION

Figure 1:
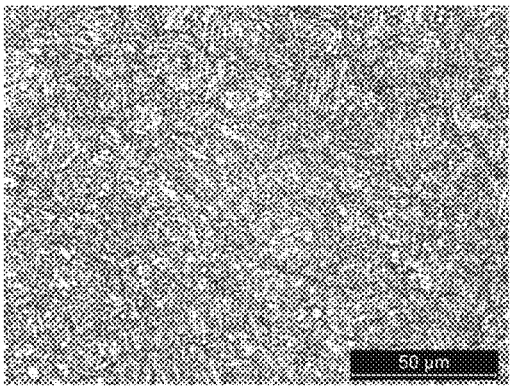
FIG. 1 is an optical microscope image (500×) of the microstructure morphology of the steel rod according to Example 3 of the present invention.

The present invention will be further illustrated below in combination with examples and the accompanying drawings. Those examples are merely used for describing the optimal implementation modes of the present invention, but not intended to make any limitation to the scope of the present invention.

Compositions of the examples of the present invention are shown in Table 1. The manufacturing method according to the examples of the present invention comprises the following steps: smelting, casting, heating, forging or rolling, quenching treatment, and tempering treatment; in the casting process, die casting or continuous casting is adopted; in the heating process, the heating temperature is 1,010-1,280° C., and the final rolling temperature or the final forging temperature is 720° C. or more; and in the rolling process, a steel billet can be directly rolled to the final specification, or the steel billet is rolled to a specified intermediate billet size and then heated and rolled to the final finished product size. The quenching temperature is 830-1,060° C. using water quenching or oil quenching, while the ratio of the quenching heating time to the thickness or diameter of the steel is 0.25 min/mm or more. The tempering temperature is 490-660° C., and perform air cooling, retarded cooling or water cooling to the steel after tempering.

Test methods: 1. the tensile property is measured in accordance with the Chinese standard GB/T228 Metallic materials—Tensile testing at ambient temperature;

2. the impact performance is measured in accordance with GB/T229 Metallic materials—Charpy pendulum impact test method; and
3. the strain aging measurement process is derived from the DNV Rules for Classification of Ships (Offshore mooring chain and accessories. Approval of manufacturers DNVGL-CP-0237 Edition July 2018).

The product according to the present invention can be used in applications such as offshore platform mooring chains and the like that require rods with high strength, and the size specification of the rods can reach a diameter of 200 mm (the diameter of the round steel in the Chinese patent CN103667953A is only 70-160 mm).

Example 1

Electric furnace or converter smelting is carried out in accordance with the compositions shown in Table 1, then casting is carried out to form a continuously casted billet or a steel ingot. The continuously casted billet or the steel ingot is heated to 1,280° C. and rolled with a final rolling temperature of 1,020° C., and the size of the intermediate billet is 260*260 mm; after rolling, retarded cooling is carried out; the intermediate billet is then heated to 1,010° C. and rolled with a final rolling temperature of 720° C. to obtain a finished product rod with a specification of φ20 mm; after rolling, air cooling is carried out; then the product rod is heated for quenching at 830° C. for 35 minutes and adopts water quenching treatment; then tempering is carried out at 490° C. for 35 minutes, and after tempering, air cooling is carried out.

Example 2

The implementation steps are the same as that in Example 1, except that the heating temperature is 1,220° C.; the final rolling temperature is 980° C.; the size of an intermediate billet is 260*260 mm; and after rolling, retarded cooling is carried out; the intermediate billet is heated to 1,050° C.; the final rolling temperature is 770° C.; the specification of the finished product rod is φ60 mm, and after rolling, water cooling is carried out; the finished product rod is heated for quenching at 880° C. for 70 minutes and adopts oil quenching treatment; then tempering is carried out at 540° C. for 80 minutes, and after tempering, retarded cooling is carried out.

Example 3

The implementation steps are the same as that in Example 1, except that the heating temperature is 1,180° C.; the final rolling temperature is 940° C.; the specification of the finished product rod is φ70 mm, and after rolling, air cooling is carried out; the finished product rod is heated for quenching at 940° C. for 90 minutes and adopts oil quenching process; then tempering is carried out at 560° C. for 100 minutes, and after tempering, water cooling is carried out.

Example 4

The implementation steps are the same as that in Example 1, except that the heating temperature is 1,110° C.; the final rolling temperature is 920° C., the specification of a finished product rod is φ110 mm, and after rolling, air cooling is carried out; the finished product rod is heated for quenching at 960° C. for 120 minutes and adopts water quenching process; then tempering is carried out at 600° C. for 180 minutes, and after tempering, air cooling is carried out.

Example 5

The implementation steps are the same as that in Example 1, except that the heating temperature is 1,080° C.; the final rolling temperature is 900° C.; the specification of the finished product rod is φ130 mm, and after rolling, retarded cooling is carried out; the finished product rod is heated for quenching at 980° C. for 170 minutes and adopts water quenching treatment; then tempering is carried out at 610° C. for 260 minutes, and after tempering, water cooling is carried out.

Example 6

The implementation steps are the same as that in Example 1, except that the heating temperature is 1,010° C.; the final rolling temperature is 870° C.; the specification of the finished product rod is φ2.00 mm, and after rolling, retarded cooling is carried out; the finished product rod is heated for quenching at 1,060° C. for 350 minutes and adopts water quenching treatment; then tempering is carried out at 660° C. for 350 minutes, and after tempering, water cooling is carried out.

Example 7

The implementation steps are the same as that in Example 1, except that the heating temperature is 1,230° C.; the final rolling temperature is 960° C.; the specification of the finished product rod is φ90 mm, and after rolling, air cooling is carried out; the finished product rod is heated for quenching at 920° C. for 30 minutes and adopts water quenching treatment; then tempering is carried out at 620° C. for 60 minutes, and after tempering, water cooling is carried out.

Example 8

The implementation steps are the same as that in Example 1, wherein the heating temperature is 1,200° C.; the final rolling temperature is 980° C., the specification of the finished product rod is φ100 mm, and after rolling, air cooling is carried out; the finished product rod is heated for quenching at 920° C. for 30 minutes and adopts water quenching treatment; then tempering is carried out at 600° C. for 60 minutes, and after tempering, water cooling is carried out.

Comparative Example 1

Then implementation steps are the same as that in Example 1, except that the heating temperature is 1,150° C.; the final rolling temperature is 960° C.; the specification of the finished product rod is φ110 mm, and after rolling, air cooling is carried out; the finished product rod is heated for quenching at 920° C. for 35 minutes and adopts water quenching treatment; then tempering is carried out at 550° C. for 60 minutes, and after tempering, water cooling is carried out.

Comparative Example 2

The implementation steps are the same as that in Example 1, except that the heating temperature is 1,120° C.; the final rolling temperature is 940° C.; the specification of the finished product rod is φ130 mm, and after rolling, air cooling is carried out; the finished product rod is heated for quenching at 910° C. for 40 minutes and adopts water quenching treatment; then tempering is carried out at 530° C. for 70 minutes, and after tempering, water cooling is carried out.

Comparative Example 3

The implementation steps are the same as that in Example 1, except that the heating temperature is 1,100° C.; the final rolling temperature is 900° C.; the specification of the finished product rod is φ100 mm, and after rolling, air cooling is carried out; the finished product rod is heated for quenching at 870° C. for 50 minutes and adopts water quenching treatment; then tempering is carried out at 520° C. for 50 minutes, and after tempering, water cooling is carried out.

Comparative Example 4

The implementation steps are the same as that in Example 1, except that the heating temperature is 1,040° C.; the final rolling temperature is 880° C.; the specification of the finished product rod is φ80 mm, and after rolling, air cooling is carried out; the finished product rod is heated for quenching is at 930° C. for 30 minutes and adopts water quenching treatment; then tempering is carried out at 600° C. for 40 minutes, and after tempering, water cooling is carried out.

The mechanical properties of the steel with controlled yield ratio in Examples 1-8 and steel in Comparative examples 1-4 in the present invention are measured based on the test methods above, and the results are shown in Table 2.

It can be seen from Table 1 and Table 2 that C and B in Comparative example 1 do not satisfy the composition range of the present invention, therefore the refining effect of C on bainite and ferrite lamellar cannot be sufficiently utilized; and relatively high B content may cause segregation of B at the grain boundaries, which will deteriorate the low-temperature impact performance, resulting in low strength and low impact energy of the steel. In Comparative example 2, the steel does not satisfy 8.57*C+1.12*Ni≥4.8%; although the tensile strength of the steel reaches 1,100 MPa, as the effect of Ni in reducing the stacking fault energy cannot be sufficiently utilized and the refining effect of C on the bainite lamellar is not effectively imparted, the low-temperature impact energy of the steel is rather low. In Comparative example 3, content of Mn and Mo exceeds the composition range of the present invention; although the solid dissolution strengthening effect of Mn improves the strength of the steel and results in a tensile strength of over 1,200 MPa, as Mn will segregate towards the grain boundaries in the welding process and relatively large carbides of Mo tend to reduce the low-temperature toughness of the steel, the impact energy of the steel of Comparative example 3 is low. In Comparative example 4, the steel does not satisfy 1.2%≤1.08 Mn+2.13Cr≤5.6%, and the Nb content exceeds the desired composition range of the present invention, therefore the solid dissolution strengthening effect of Mn and Cr and the carbide precipitation strengthening effect of Cr cannot be sufficiently utilized, resulting in the formation of coarse NbC precipitate particles, therefore the steel of Comparative example 4 only have a yield strength of 890 MPa, a tensile strength which does not reach 1,100 MPa, a yield ratio of 0.84, and low impact energy.

Figure 2:
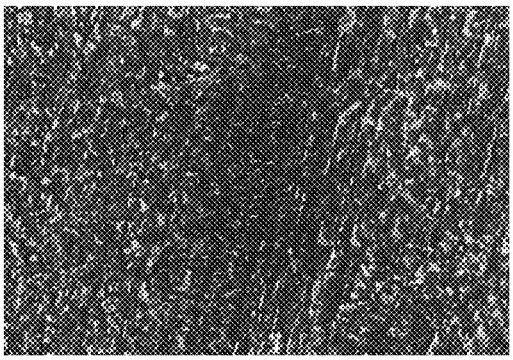
FIG. 2 is a scanning electron microscope image (10,000×) of the microstructure morphology of the steel rod according to Example 3 of the present invention.

The steel with controlled yield ratio provided by the present invention has a Charpy impact energy $A_{kv}$ at −20° C. of 90J or more, a Charpy impact energy $A_{kv}$ at −40° C. of 70J or more, a Charpy impact energy $A_{kv}$ at −20° C. of 80J or more after holding at a temperature of 100° C. for 1 h after 5% strain, a Charpy impact energy $A_{kv}$ at −40° C. of 60J or more after holding at a temperature of 100° C. for 1 h after 5% strain, a yield ratio of 0.85-0.95, a tensile strength of 1,100 MPa or more, a yield strength of 900 MPa or more, an elongation rate of 15% or more, an area reduction of 50% or more, a strength toughness product (Tensile Strength*Charpy Impact Energy $A_{kv}$ at −20° C.) of 115 GPa*J or more, and a strength plasticity product (Tensile Strength*Elongation Rate) of 16 GPa*% or more With reference to FIG. 1 and FIG. 2, it can be seen from FIG. 1 and FIG. 2 that the microstructure of the steel rod in Example 3 of the present invention is tempered martensite and tempered bainite. The width of the tempered bainite or tempered martensite lath is 0.3-2 μm. Nano-scaled carbide precipitates can be seen inside the lath, and fine lamellar-shaped cementite precipitates with a thickness of 50 nm and a length of about 0.2-2 μm along the interface of the lath.

TABLE 1

Unit: %

| | C | Si | Mn | P | S | Cr | Mo | Nb | Ni | Cu | V | B | Al | Ti | Ca | H | N | O |
|---|---|---|---|---|---|---|---|---|---|---|---|---|---|---|---|---|---|---|
| Example 1 | 0.245 | 0.80 | 2.0 | 0.015 | 0.002 | 0.2 | 0.9 | 0.08 | 3.4 | 0.2 | 0.13 | 0.0010 | 0.03 | 0.050 | 0.0035 | 0.00020 | 0.010 | 0.0015 |
| Example 2 | 0.26 | 0.35 | 0.2 | 0.012 | 0.001 | 2.5 | 0.4 | 0.05 | 2.6 | 0 | 0.03 | 0.0015 | 0.05 | 0.030 | 0.0020 | 0.00018 | 0.004 | 0.0020 |

TABLE 1-continued

Unit: %

| | C | Si | Mn | P | S | Cr | Mo | Nb | Ni | Cu | V | B | Al | Ti | Ca | H | N | O |
|---|---|---|---|---|---|---|---|---|---|---|---|---|---|---|---|---|---|---|
| Example 3 | 0.28 | 0.50 | 1.4 | 0.007 | 0.003 | 1.8 | 0.6 | 0.04 | 2.3 | 0.3 | 0.10 | 0.0020 | 0.01 | 0.010 | 0.0025 | 0.00010 | 0.006 | 0.0010 |
| Example 4 | 0.30 | 0.10 | 0.8 | 0.006 | 0.002 | 1.0 | 0.5 | 0 | 3.8 | 0.1 | 0.06 | 0 | 0.06 | 0.005 | 0.0015 | 0.00007 | 0.007 | 0.0011 |
| Example 5 | 0.32 | 0.25 | 0.5 | 0.011 | 0.001 | 1.5 | 0.2 | 0.01 | 3.2 | 0 | 0.01 | 0 | 0.03 | 0.002 | 0.0010 | 0.00011 | 0.013 | 0.0009 |
| Example 6 | 0.365 | 0.60 | 1.6 | 0.01 | 0.003 | 0.8 | 0.1 | 0.02 | 4.2 | 0 | 0.05 | 0 | 0.04 | 0 | 0 | 0.00010 | 0.002 | 0.0015 |
| Example 7 | 0.245 | 0.1 | 0.3 | 0.01 | 0.002 | 0.7 | 0.35 | 0 | 2.5 | 0 | 0.04 | 0.0003 | 0.015 | 0.003 | 0.0015 | 0.00013 | 0.006 | 0.0013 |
| Example 8 | 0.33 | 0.8 | 0.8 | 0.015 | 0.003 | 1.6 | 0.8 | 0.01 | 3.5 | 0.3 | 0.11 | 0.001 | 0.05 | 0.004 | 0.0018 | 0.00010 | 0.008 | 0.0016 |
| Comparative example 1 | **0.23** | 0.60 | 1.10 | 0.015 | 0.003 | 0.9 | 0.7 | 0.03 | 2.9 | 0.2 | 0.03 | **0.005** | 0.04 | 0.008 | 0.0020 | 0.00010 | 0.008 | 0.0018 |
| Comparative example 2 | 0.25 | 0.7 | 0.3 | 0.015 | 0.003 | 0.8 | 0.4 | 0.02 | 2.3 | 0.1 | 0.04 | 0.001 | 0.02 | 0.02 | 0.0015 | 0.00015 | 0.006 | 0.002 |
| Comparative example 3 | 0.28 | 0.5 | **2.5** | 0.015 | 0.003 | 1.2 | **1** | 0.02 | 3.2 | 0 | 0.05 | 0 | 0.02 | 0.01 | 0.002 | 0.00017 | 0.009 | 0.0015 |
| Comparative example 4 | 0.3 | 0.8 | 0.6 | 0.012 | 0.002 | 0.25 | 0.6 | **0.10** | 2.9 | 0.2 | 0.08 | 0.0008 | 0.03 | 0.007 | 0.0018 | 0.00016 | **0.015** | 0.002 |

TABLE 2

| | Charpy Impact Energy $A_{kv}$ J | | 5% Strain Aged Charpy Impact Energy $A_{kv}$ J | | Yield Strength | Tensile Strength | Yield Ratio | Elongation rate % | Area Reduction % | Strength Toughness Product (Tensile Strength*Impact Energy $A_{kv}$ at −20° C.) GPa*J | Strength Plasticity Product (Tensile Strength*Elongation rate) GPa*% |
|---|---|---|---|---|---|---|---|---|---|---|---|
| | −20° C. | −40° C. | −20° C. | −40° C. | MPa | MPa | | | | | |
| Example 1 | 142 | 128 | 122 | 116 | 1147 | 1233 | 0.93 | 16 | 61 | 175 | 20 |
| Example 2 | 138 | 121 | 115 | 108 | 1118 | 1215 | 0.92 | 16 | 64 | 168 | 19 |
| Example 3 | 151 | 139 | 123 | 113 | 1057 | 1188 | 0.89 | 17 | 63 | 179 | 20 |
| Example 4 | 133 | 115 | 117 | 115 | 1098 | 1220 | 0.90 | 15 | 62 | 162 | 18 |
| Example 5 | 121 | 109 | 107 | 105 | 1078 | 1253 | 0.86 | 16 | 61 | 152 | 20 |
| Example 6 | 116 | 104 | 108 | 98 | 1205 | 1282 | 0.94 | 15 | 63 | 149 | 19 |
| Example 7 | 147 | 128 | 130 | 112 | 1092 | 1165 | 0.94 | 16 | 62 | 171 | 19 |
| Example 8 | 132 | 111 | 122 | 103 | 1110 | 1190 | 0.93 | 16 | 61 | 157 | 19 |
| Comparative example 1 | 101 | 57 | 70 | 34 | 985 | 1055 | 0.92 | 16 | 60 | 107 | 17 |
| Comparative example 2 | 56 | 48 | 32 | 24 | 990 | 1110 | 0.89 | 15 | 58 | 62 | 17 |
| Comparative example 3 | 42 | 34 | 21 | 17 | 1096 | 1201 | 0.91 | 14 | 55 | 50 | 17 |
| Comparative example 4 | 51 | 37 | 32 | 18 | 890 | 1060 | 0.84 | 14 | 56 | 54 | 15 |

What is claimed is:

1. A steel with controlled yield ratio, comprising the following components in percentage by mass: C: 0.245-0.365%, Si: 0.10-0.80%, Mn: 0.20-2.00%, P: ≤0.015%, S: ≤0.003%, Cr: 0.20-2.50%, Mo: 0.10-0.90%, Nb: 0-0.08%, Ni: 2.30-4.20%, Cu: 0-0.30%, V: 0.01-0.13%, B: over 0 to 0.0020%, Al: 0.01-0.06%, Ti: 0-0.05%, Ca: ≤0.004%, H: ≤0.0002%, N: ≤0.013%, O: ≤0.0020%, and the balance of Fe and inevitable impurities, wherein the components satisfy (8.57*C+1.12*Ni)≥4.8% and 1.2%≤(1.08*Mn+2.13*Cr)≤5.6%; and the steel with controlled yield ratio has a yield ratio of 0.85-0.95, a tensile strength of 1,100 MPa or more, and a yield strength of 900 MPa or more.

2. The steel with controlled yield ratio of claim 1, wherein a microstructure of the steel with controlled yield ratio is tempered martensite+tempered bainite.

3. The steel with controlled yield ratio of claim 2, wherein the steel with controlled yield ratio has a Charpy impact energy $A_{kv}$ at −20° C. of 90 J or more, a Charpy impact energy $A_{kv}$ at −40° C. of 70 J or more, a Charpy impact energy $A_{kv}$ at −20° C. of 80 J or more after holding at a temperature of 100° C. for 1 h after 5% strain, a Charpy impact energy $A_{kv}$ at −40° C. of 60 J or more after holding at a temperature of 100° C. for 1 h after 5% strain, a yield ratio of 0.85-0.95, a tensile strength of 1,100 MPa or more, a yield strength of 900 MPa or more, an elongation rate of 15% or more, an area reduction of 50% or more, a strength toughness product (Tensile Strength*Charpy Impact Energy $A_{kv}$ at −20° C.) of 115 GPa*J or more, and a strength plasticity product (Tensile Strength*Elongation Rate) of 16 GPa* % or more.

4. The steel with controlled yield ratio of claim 1, wherein the steel with controlled yield ratio has a Charpy impact energy $A_{kv}$ at −20° C. of 90 J or more, a Charpy impact energy $A_{kv}$ at −40° C. of 70 J or more, a Charpy impact energy $A_{kv}$ at −20° C. of 80 J or more after holding at a temperature of 100° C. for 1 h after 5% strain, a Charpy impact energy $A_{kv}$ at −40° C. of 60 J or more after holding at a temperature of 100° C. for 1 h after 5% strain, a yield ratio of 0.85-0.95, a tensile strength of 1,100 MPa or more, a yield strength of 900 MPa or more, an elongation rate of 15% or more, an area reduction of 50% or more, a strength toughness product (Tensile Strength*Charpy Impact Energy $A_{kv}$ at −20° C.) of 115 GPa*J or more, and a strength plasticity product (Tensile Strength*Elongation Rate) of 16 GPa* % or more.

5. A manufacturing method for the steel with controlled yield ratio according to claim 1, comprising the following steps:

S1: smelting and casting, wherein the smelting and casting are carried out according to the components in claim 1 to form a casting billet;

S2: heating, wherein the casting billet is heated at a heating temperature of 1,010-1,280° C.;

S3: rolling or forging, wherein a final rolling temperature is 720° C. or more or a final forging temperature is 720° C. or more; and performing air cooling, water cooling or retarded cooling after the rolling;

S4: quenching heat treatment, wherein the quenching is performed at a quenching temperature of 830-1,060° C. using water quenching or oil quenching, and a ratio of the quenching time to the thickness or diameter of the steel is 0.25 min/mm or more; and S5: tempering heat treatment, wherein a tempering temperature is 490-660° C., a ratio of the tempering time to the thickness or diameter of the steel is 0.25 min/mm or more, and performing air cooling, retarded cooling or water cooling after the tempering.

6. The manufacturing method for the steel with controlled yield ratio of claim 5, wherein a microstructure of the steel with controlled yield ratio is tempered martensite+tempered bainite.

7. The manufacturing method for the steel with controlled yield ratio of claim 6, wherein the steel with controlled yield ratio has a Charpy impact energy $A_{kv}$ at −20° C. of 90 J or more, a Charpy impact energy $A_{kv}$ at −40° C. of 70 J or more, a Charpy impact energy $A_{kv}$ at −20° C. of 80 J or more after holding at a temperature of 100° C. for 1 h after 5% strain, a Charpy impact energy $A_{kv}$ at −40° C. of 60 J or more after holding at a temperature of 100° C. for 1 h after 5% strain, a yield ratio of 0.85-0.95, a tensile strength of 1,100 MPa or more, a yield strength of 900 MPa or more, an elongation rate of 15% or more, an area reduction of 50% or more, a strength toughness product (Tensile Strength*Charpy Impact Energy $A_{kv}$ at −20° C.) of 115 GPa*J or more, and a strength plasticity product (Tensile Strength*Elongation Rate) of 16 GPa* % or more.

8. The manufacturing method for the steel with controlled yield ratio of claim 5, wherein the steel with controlled yield ratio has a Charpy impact energy $A_{kv}$ at −20° C. of 90 J or more, a Charpy impact energy $A_{kv}$ at −40° C. of 70 J or more, a Charpy impact energy $A_{kv}$ at −20° C. of 80 J or more after holding at a temperature of 100° C. for 1 h after 5% strain, a Charpy impact energy $A_{kv}$ at −40° C. of 60 J or more after holding at a temperature of 100° C. for 1 h after 5% strain, a yield ratio of 0.85-0.95, a tensile strength of 1,100 MPa or more, a yield strength of 900 MPa or more, an elongation rate of 15% or more, an area reduction of 50% or more, a strength toughness product (Tensile Strength*Charpy Impact Energy $A_{kv}$ at −20° C.) of 115 GPa*J or more, and a strength plasticity product (Tensile Strength*Elongation Rate) of 1 GPa* % or more.

* * * * *